US005813784A

United States Patent [19]

Durliat

[11] Patent Number: 5,813,784

[45] Date of Patent: Sep. 29, 1998

[54] SOLID DEODORANT SAMPLER PACKAGE

[75] Inventor: Leonora M. Durliat, Toledo, Ohio

[73] Assignee: Owens-Illinois Closure INc., Toledo, Ohio

[21] Appl. No.: 723,648

[22] Filed: Oct. 3, 1996

[51] Int. Cl.[6] ..... A45D 40/00; A45D 40/16

[52] U.S. Cl. ..... 401/98; 401/88

[58] Field of Search ..... 401/88, 98, 75

[56] References Cited

U.S. PATENT DOCUMENTS

| | | | |
|---|---|---|---|
| 2,815,057 | 12/1957 | Tupper . | |
| 4,235,557 | 11/1980 | Hayes . | |
| 4,369,158 | 1/1983 | Woodruff et al. . | |
| 4,605,330 | 8/1986 | Crowley et al. | 401/75 X |
| 4,728,210 | 3/1988 | Barish et al. . | |
| 4,794,936 | 1/1989 | Zango . | |
| 4,890,944 | 1/1990 | Cousins et al. | 401/75 X |
| 4,950,094 | 8/1990 | Yorks | 401/75 |
| 5,046,875 | 9/1991 | Skolink . | |
| 5,092,700 | 3/1992 | Susini et al. . | |
| 5,167,462 | 12/1992 | Lucas | 401/87 X |
| 5,221,153 | 6/1993 | Spatz | 401/88 X |
| 5,326,185 | 7/1994 | Dornbusch et al. . | |
| 5,368,178 | 11/1994 | Towns et al. . | |
| 5,401,112 | 3/1995 | Dombusch et al. | 401/75 X |
| 5,496,122 | 3/1996 | Fattori . | |

*Primary Examiner*—Steven A. Bratlie

[57] ABSTRACT

A solid deodorant sampler package and method of making wherein the package includes a plastic body having an open upper end, an open lower end, an integral upwardly and outwardly curved base wall in the form of a grid, and a peripheral wall. The grid is positioned between the upper and lower edges of the peripheral wall, and supports a solid deodorant. A plastic cover includes a base wall and a peripheral skirt telescoped over the peripheral wall of the body. The solid deodorant substantially fills the space between the base wall of the plastic cover and the base wall of the plastic body.

33 Claims, 4 Drawing Sheets

SOLID DEODORANT SAMPLER PACKAGE

This invention relates to solid deodorant packages and particularly to sampler-type deodorant packages.

BACKGROUND AND SUMMARY OF THE INVENTION

Normal deodorant packages, whether roll-on, push-up, or twist-up, are very assembly intensive due to the dispensing mechanisms required to place the product in an application position. The present design molds the usage product into a ready-to-dispense form. There is no advancing or retracting required by the consumer. Also the package appears identical to current twist-up style "sampler" packages.

When packaging a solid-type (as opposed to a roll-on, lotion type) deodorant, a domed application surface is a highly desired consumer feature. To achieve this, normal deodorant packages must fill the base with molten deodorant, place a dome-forming factory seal on top, cap the package, and invert until the product solidifies. Another process is to fill the base with more deodorant than required, let solidify, advance product, machine a dome into the product, retract product, and cap.

Among the objectives of the present invention are to provide a solid deodorant sampler package which appears to a consumer to be substantially the same as conventional full size solid deodorant packages; which is easier to manufacture, less costly, and more readily recyclable.

In accordance with the invention, a solid deodorant sampler package comprises a plastic body having an open upper end, an open lower end, an integral upwardly and outwardly curved base wall in the form of a grid, and a peripheral wall. The grid is positioned between the upper and lower edges of the peripheral wall and supports a solid deodorant. A plastic cover includes a base wall and a peripheral skirt telescoped over the peripheral wall of the body. The solid deodorant substantially fills the space between the base wall of the plastic cover and the base wall of the plastic body. The plastic body preferably has an inner surface and the grid comprises an integral annular rib extending from the inner surface of the plastic body. The plastic body preferably includes an inwardly extending bead spaced between the grid and the rib embedded in the deodorant. The grid also preferably comprises spaced upwardly curved ribs interconnected by spaced outwardly concave ribs. The peripheral wall of the plastic body is preferably generally oval in cross section and the peripheral skirt of the plastic cover is complementary thereto.

DETAILED DESCRIPTION OF THE PREFERRED EMBODIMENT

Figure 1:
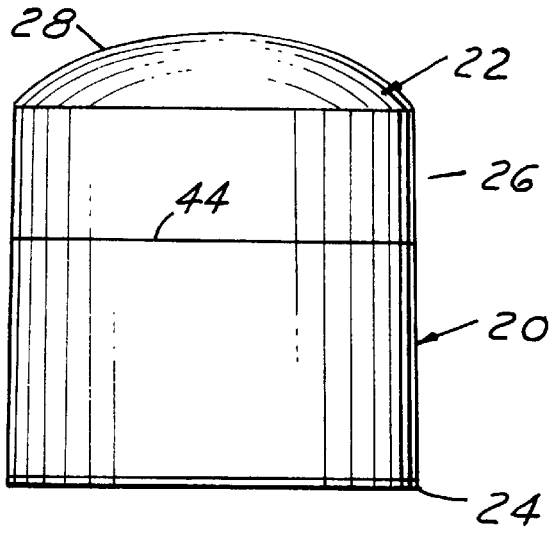
FIG. 1 is a front elevational view of the solid deodorant sampler package embodying the invention.
Figure 2:
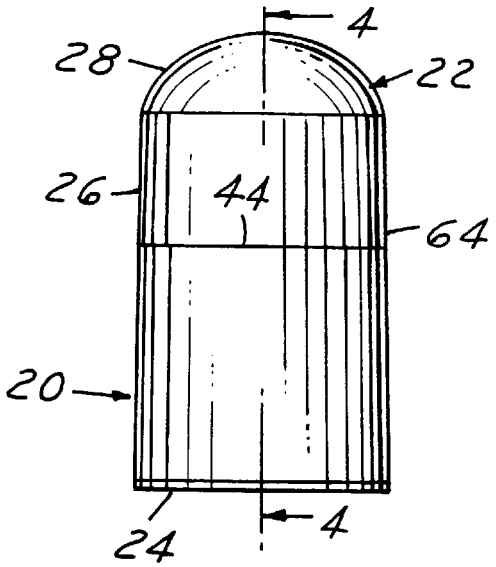
FIG. 2 is a side elevational view taken from the right or left in FIG. 1.
Figure 3:
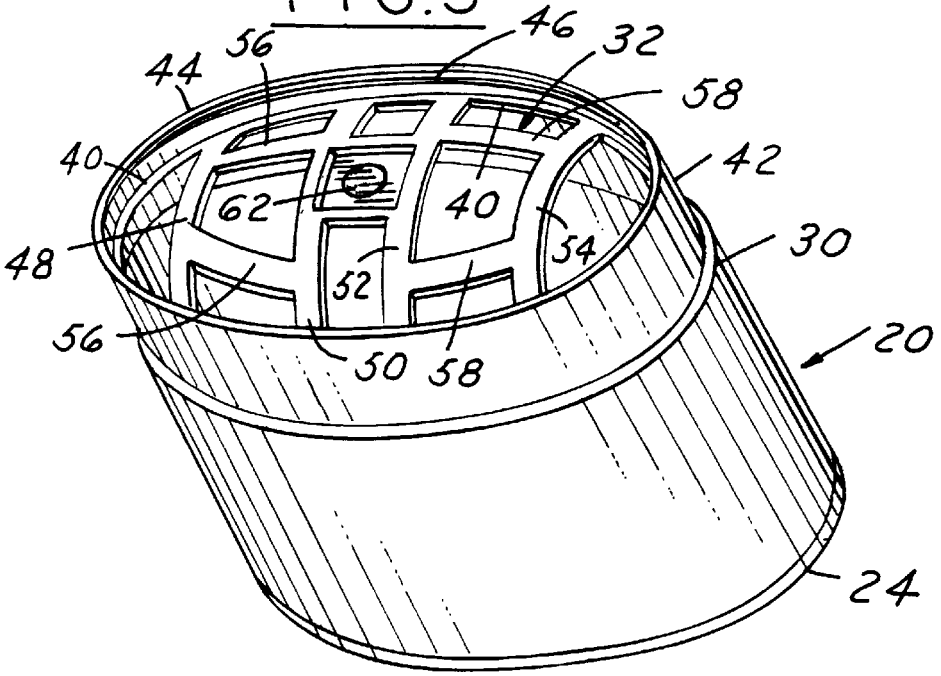
FIG. 3 is a perspective view of a portion of the package.
Figure 4:
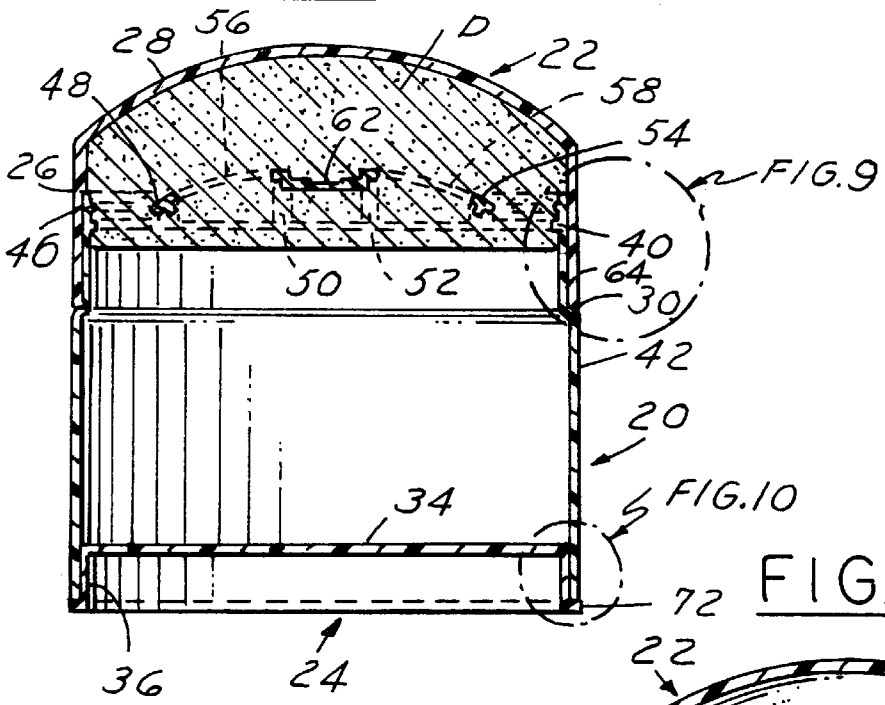
FIG. 4 is a vertical sectional view taken along the line 4—4 in FIG. 2.
Figure 5:
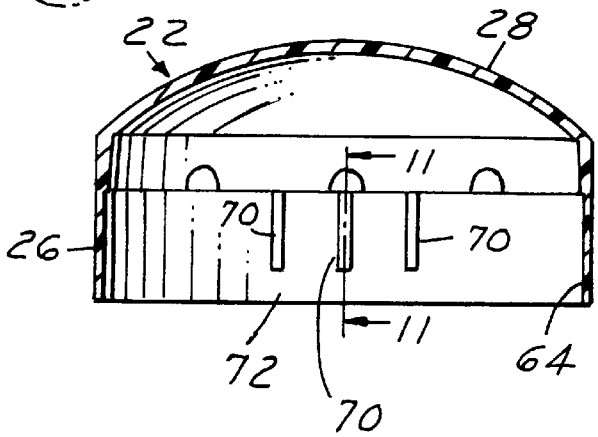
FIG. 5 is a vertical sectional view of the cover of the package shown in FIG. 4.
Figure 6:
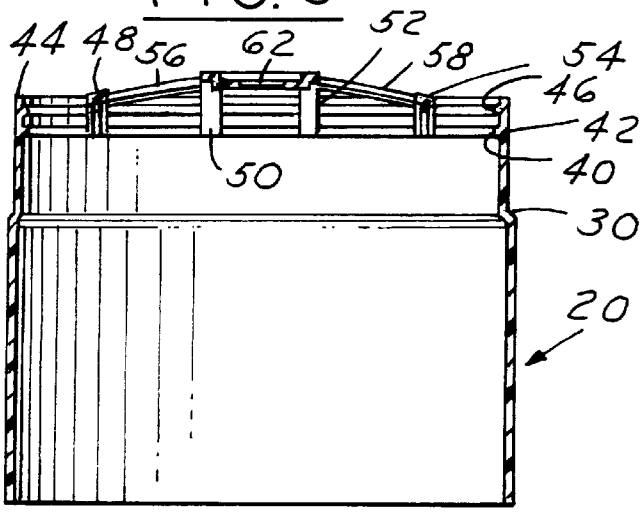
FIG. 6 is a vertical sectional view of the body of the package shown in FIG. 4.

Referring to FIGS. 1, 2 and 4, the sampler solid deodorant package embodying the invention comprises a plastic body 20, a plastic cover 22 and a plastic bottom plug 24 closing the bottom of body 20. The cross section of the body 20 is preferably oval in horizontal cross section as is the cross section of the peripheral skirt 26 of the cover 22. The cover 22 includes an upwardly curved ellipsoidal base wall 28 closing the upper end of the cover 22. Body 20 includes a shoulder 30 engaged by the skirt 26 of the cover 22, as presently described. Body 20 includes an integral ellipsoidal dome 32 (FIG. 3) in the form of a grid, as presently described, which holds and supports solid deodorant D, a portion of the deodorant D extends through openings in the dome 32, as presently described. The solid deodorant D extends to the inside concave surface of the ellipsoidal base wall 28 of cover 22 (FIG. 4). Plug 24 comprises a transverse wall 34 and a peripheral skirt 36 and is press fitted in the open bottom end of body 20.

The body 20, cover 22 and plug 24 are preferably made of plastic such as polypropylene. However, other plastic materials can be used.

In order to fill the package, the cover 22 is placed on the body 20 to provide an assembly which is inverted with the open end of body 20 extending upwardly. Molten deodorant is poured into the assembly to fill the space between the exposed inside surfaces of the cover to a level wherein the molten deodorant extends through the openings in the dome 32 such that when the deodorant solidifies, it is retained by the dome 32 permitting a user to remove the cover 22 and use the deodorant.

Figure 8:
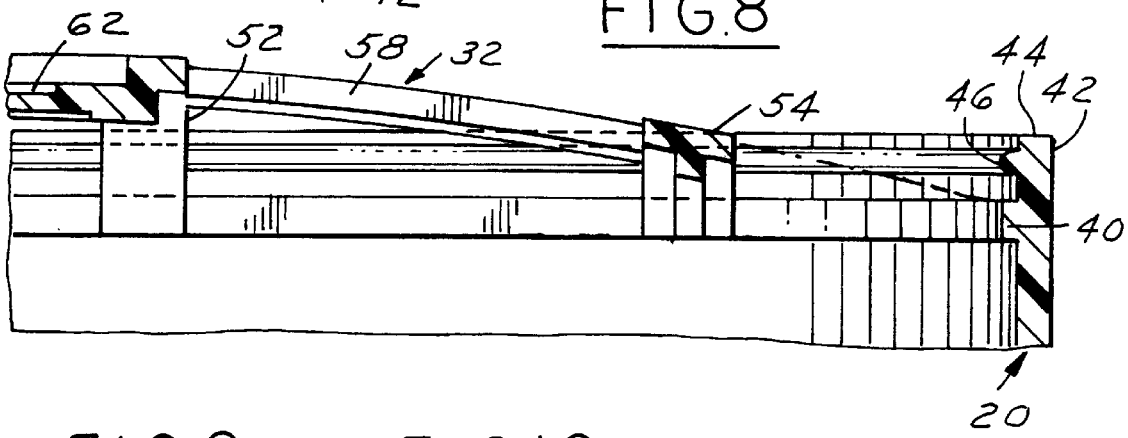
FIG. 8 is a sectional view of the body on an enlarged scale taken along the line 8—8 in FIG. 7.

As shown in FIG. 8, the periphery of the dome 32 includes an inwardly extending annular rib 40 extending from thin wall 42 of body 20 and spaced from the upper end 44 of wall 42. This strengthens the construction of body 20 and minimizes the amount of plastic required. Body 20 includes an inwardly extending bead 46 spaced below the upper end 44 of wall 42 and the rib 40. This bead 46 assists in retention of solid deodorant in the portion of wall 42 above rib 40, assisting adhesion and increasing resistance of the deodorant when the cover 22 is removed.

Figure 7:
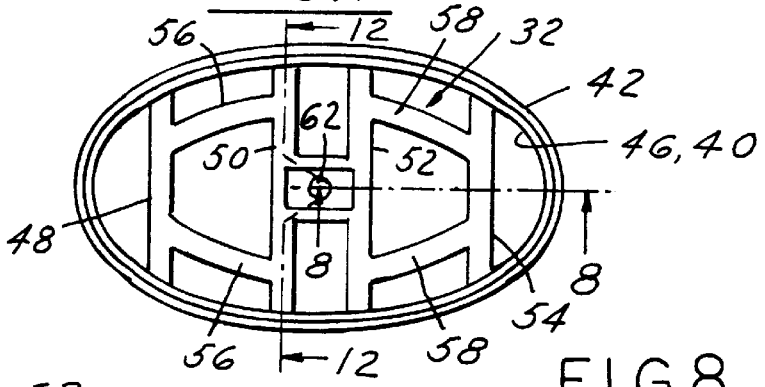
FIG. 7 is a top plan view of the body of the package shown in FIG. 6.

Referring to FIG. 7, the dome 32 preferably comprises spaced integral upwardly curved transverse ribs 48, 50, 52, 54 interconnected by outwardly concave integral curved ribs 56, 58 extending along the long axis of dome 32. An integral bridge portion extends between ribs 50, 52. This bridge portion includes a recess 62 in the upper portion thereof which is a well for the gate through which plastic is injected during the molding of the body 20.

Figure 9:
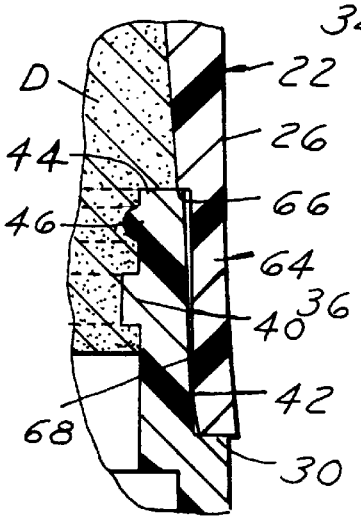
FIG. 9 is a fragmentary sectional view on an enlarged scale of the portion of the package taken at the circle FIG. 9 in FIG. 4.
Figure 10:
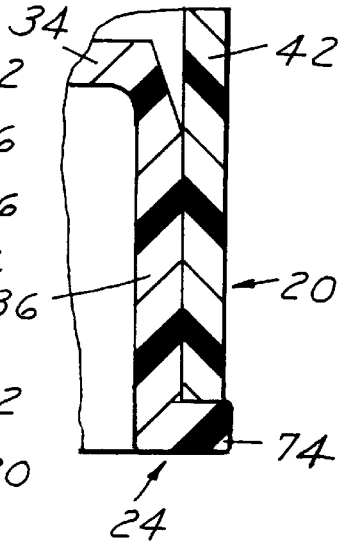
FIG. 10 is a fragmentary sectional view on an enlarged scale of a portion of the package taken at the circle FIG. 10 in FIG. 4.
Figure 11:
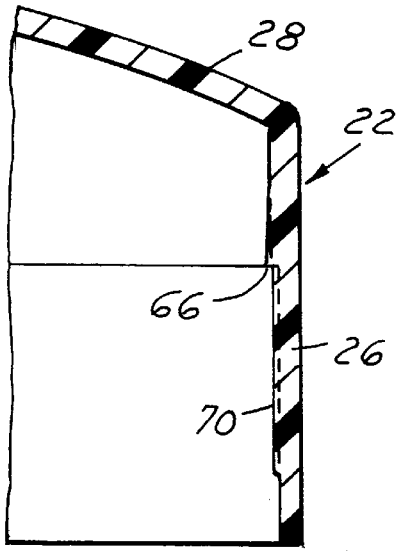
FIG. 11 is a fragmentary sectional view on an enlarged scale taken along the line 11—11 in FIG. 5.
Figure 12:
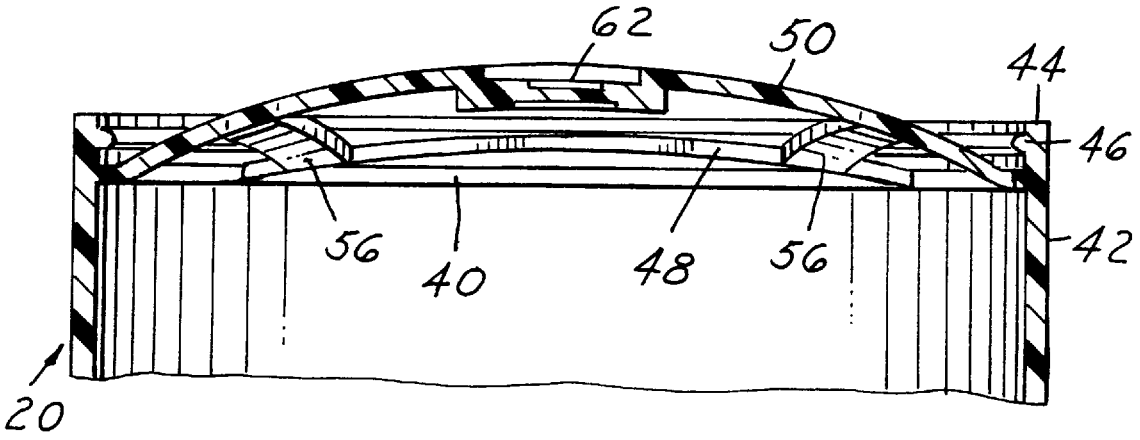
FIG. 12 is a sectional view on an enlarged scale taken along the line 12—12 in FIG. 7.

Referring to FIG. 9, skirt 26 of cover 22 has a thin portion 64 defining a shoulder 66. The lower end of the thin portion 64 of peripheral skirt 26 of the cover 22 engages an upwardly facing shoulder 30 spaced below the upper end of the wall 42 of body 20 (FIG. 10). The shoulder 66 of the cover engages the upper end 44 of wall 42. The inner surface 68 of thin portion 64 is convex in vertical section and engages the portion of wall 42 of body 20 intermediate the upper edge 44 and shoulder 30. The outer lower edge of skirt portion 64 extends radially outwardly beyond shoulder 30 to facilitate gripping of the cover 22 by the user.

Cover 22 includes circumferentially spaced vertical venting ribs 70 along the long sides 72 of skirt 26 of cover 22 to allow for more ready removal of the cover 22. As the cover 22 is lifted, the ribs 70 permit air to enter the package facilitating removal.

As shown in FIGS. 10, the plug 24 preferably includes an annular flange 74 which extends radially outwardly below the lower edge of wall 42. This assists in providing rigidity to the thin wall 42 and aids is protecting any label on the outer surface of wall 42.

It can thus be seen that there has been provided a solid deodorant sampler package which appears to a consumer to be substantially the same as conventional full size solid deodorant packages; which is easier to manufacture, less costly, and readily recyclable.

I claim:

1. A solid deodorant sampler package that comprises:

a plastic body having a peripheral wall with an open upper end surrounded by an upper edge, and an upwardly and outwardly curved base wall within said peripheral wall in the form of an open grid integrally joined to said peripheral wall at a position spaced from said upper edge such that a portion of said peripheral wall extends between said base wall and said upper edge, a plastic cover including a base wall and a peripheral skirt telescoped over said upper edge and said portion of said peripheral wall, and a solid deodorant non-movably filling the space between said base wall of said body and said base wall of said cover, said solid deodorant being formed in situ in said body such that said base wall of said body is embedded in said deodorant and a peripheral portion of said deodorant is surrounded by said portion of said peripheral wall between said base wall and said upper edge of said body.

2. The package set forth in claim 1 wherein said grid includes a circumferentially continuous rib extending entirely around an inner surface of said peripheral wall of said plastic body, said rib being embedded in said solid deodorant.

3. The package set forth in claim 2 wherein said plastic body includes an inwardly extending bead positioned between said rib and said upper edge, and embedded in said solid deodorant.

4. The solid deodorant sampler package set forth in claim 3 wherein said grid comprises spaced upwardly curved ribs interconnected by spaced outwardly concave ribs.

5. The solid deodorant sampler package set forth in claim 4 wherein said grid includes a central recess.

6. The package set forth in claim 3 wherein said peripheral wall of said plastic body has an outer surface with a shoulder engaged by said peripheral skirt of said plastic cover.

7. The package set forth in claim 3 wherein said peripheral skirt of said plastic cover includes an internal shoulder in engagement with said upper edge of said plastic body a portion of said skirt extending from said shoulder surrounding said portion of said peripheral wall.

8. The package set forth in claim 7 wherein said skirt portion has a convex inner surface engaging said peripheral wall.

9. The solid deodorant sampler package set forth in claim 8 wherein said portion of said skirt of said plastic cover has an outer lower edge extending radially outwardly from said peripheral wall of the plastic body.

10. The package set forth in claim 8 wherein said skirt portion of said plastic cover has a plurality of peripherally spaced longitudinally extending ribs in radial engagement with said outer surface of said peripheral wall to space said skirt form said peripheral wall and thereby facilitate removal of said cover by venting the interior of said cover.

11. The solid deodorant sampler package set forth in any one of claims 1–3, 6–8, 10 wherein said peripheral wall of said plastic body is generally oval in cross section and said peripheral skirt of said plastic cover is complementary thereto.

12. A body and cover assembly for use in a solid deodorant sampler package, said assembly comprising:

a plastic body having a peripheral wall with an open upper end surrounded by an upper edge, and an upwardly and outwardly curved base wall within said peripheral wall in the form of an open grid integrally joined to said peripheral wall at a position spaced from said upper edge such that a portion of said peripheral wall extends between said base wall and said upper edge, a plastic cover including a base wall and a peripheral skirt telescoped over said upper edge and said portion of said peripheral wall, said plastic body being adapted to hold a solid deodorant non-movably filling the space between said base wall of said body and said base wall of said cover such that said base wall of said body is embedded in said deodorant and a peripheral portion of said deodorant is surrounded by said portion of said peripheral wall between said base wall and said upper edge of said body.

13. The assembly set forth in claim 12 wherein said grid includes a circumferentially continuous rib extending entirely around an inner surface of said peripheral wall of said plastic body, said rib being disposed to be embedded in said solid deodorant.

14. The assembly set forth in claim 13 wherein said plastic body includes an inwardly extending bead positioned between said rib and said upper edge, and adapted to be embedded in said solid deodorant.

15. The assembly set forth in claim 14 wherein said grid comprises spaced upwardly curved ribs interconnected by spaced outwardly concave ribs.

16. The assembly set forth in claim 15 wherein said grid includes a central recess.

17. The assembly set forth in claim 14 wherein said peripheral wall of said plastic body has an outer surface with a shoulder engaged by said peripheral skirt of said plastic cover.

18. The assembly set forth in claim 13 wherein said peripheral skirt of said plastic cover includes an internal shoulder in engagement with said upper edge of said plastic body a portion of said skirt extending from said shoulder surrounding said portion of said peripheral wall.

19. The assembly set forth in claim 18 wherein said skirt portion has a convex inner surface engaging said peripheral wall.

20. The assembly set forth in claim 19 wherein said portion of said skirt of said plastic cover has an outer lower edge extending radially outwardly from said peripheral wall of the plastic body.

21. The assembly set forth in claim 19 wherein said skirt portion of said plastic cover has a plurality of peripherally spaced longitudinally extending ribs in radial engagement with said outer surface of said peripheral wall to space said skirt form said peripheral wall and thereby facilitate removal of said cover by venting the interior of said cover.

22. The assembly set forth in any one of claims 12–14, 17–19, 21 wherein said peripheral wall of said plastic body is generally oval in cross section and said peripheral skirt of said plastic cover is complementary thereto.

23. A method of making a solid deodorant sampler package that comprises the steps of:

(a) providing a plastic body having a peripheral wall with an open upper end surrounded by an upper edge, and an upwardly and outwardly curved base wall within said peripheral wall in the form of an open grid integrally joined to said peripheral wall at a position spaced from said upper edge such that a portion of said peripheral wall extends between said base wall and said upper edge, (b) providing a plastic cover including a base wall and a peripheral skirt, (c) telescoping said plastic cover over said upper edge and said portion of said peripheral wall, and (d) filling the space between said base wall of said body and said base wall of said cover with a non-movable solid deodorant by forming said deodorant in situ in said body such that said base wall of said body is embedded in said deodorant and a peripheral portion of said deodorant is surrounded by said portion of said peripheral wall between said base wall and said upper edge of said body.

24. The method set forth in claim 23 wherein said step (a) is such that said grid includes a circumferentially continuous rib extending entirely around an inner surface of said peripheral wall of said plastic body, and wherein said step (d) is such that said rib is embedded in said solid deodorant.

25. The method set forth in claim 24 wherein said step (a) is such that said plastic body includes an inwardly extending bead positioned between said rib and said upper edge, and wherein said step (d) is such that said bead is embedded in said solid deodorant.

26. The method set forth in claim 25 wherein said step of forming said plastic body comprises forming grid comprises spaced upwardly curved ribs interconnected by spaced outwardly concave ribs.

27. The method set forth in claim 26 wherein said step of forming said plastic body is such that said grid includes a central recess.

28. The method set forth in claim 25 wherein said step (a) is such that said peripheral wall of said plastic body has an outer surface with a shoulder engaged by said peripheral skirt of said plastic cover following said step (c).

29. The method set forth in claim 25 wherein said step (b) is such that said peripheral skirt of said plastic cover includes an internal shoulder in engagement with said upper edge of said plastic body following said step (c), a portion of said skirt extending from said shoulder surrounding said portion of said peripheral wall.

30. The method set forth in claim 29 wherein said step (c) is such that skirt portion has a convex inner surface engaging said peripheral wall.

31. The method set forth in claim 30 wherein said step of forming said plastic cover is such that said portion of said skirt of said plastic cover has an outer lower edge extending radially outwardly from said peripheral wall of the plastic body.

32. The method set forth in claim 30 wherein said step (b) is such that said skirt portion of said plastic cover has a plurality of peripherally spaced longitudinally extending ribs in radial engagement with said outer surface of said peripheral wall following said step (c) to space said skirt form said peripheral wall and thereby facilitate removal of said cover by venting the interior of said cover.

33. The method set forth in any one of claims 23–25, 28–30, 32 wherein said step of forming said plastic body and said step of forming said plastic cover comprises forming said peripheral wall of said plastic body such that it is generally oval in cross section and forming said peripheral skirt of said plastic cover such that it is complementary thereto.

* * * * *